US006751977B2

(12) United States Patent
Sands et al.

(10) Patent No.: US 6,751,977 B2
(45) Date of Patent: Jun. 22, 2004

(54) AUTOMATED FREEZER COMPONENT

(75) Inventors: Jeffrey L. Sands, Freeport, IL (US); James D. Conlin, South Beloit, IL (US)

(73) Assignee: Carrier Commercial Refrigeration, Inc., Syracuse, NY (US)

( * ) Notice: Subject to any disclaimer, the term of this patent is extended or adjusted under 35 U.S.C. 154(b) by 60 days.

(21) Appl. No.: 10/124,736

(22) Filed: Apr. 17, 2002

(65) Prior Publication Data

US 2003/0196446 A1 Oct. 23, 2003

(51) Int. Cl.[7] ..... F25D 25/00; F25D 25/02
(52) U.S. Cl. ..... 62/378; 62/382; 62/381
(58) Field of Search ..... 62/378, 381, 382, 62/63, 60, 371; 221/150 R, 150 HC, 150 A

(56) References Cited

U.S. PATENT DOCUMENTS

| | | | | |
|---|---|---|---|---|
| 3,075,670 A | * | 1/1963 | Brugger | 221/76 |
| 4,831,841 A | | 5/1989 | Falk | |
| 5,210,387 A | | 5/1993 | Smith et al. | |
| 5,245,150 A | * | 9/1993 | Grandi | 219/753 |
| 5,319,939 A | * | 6/1994 | McFadden et al. | 62/63 |
| 5,540,943 A | | 7/1996 | Naramura | |
| 5,562,183 A | | 10/1996 | Naramura | |
| 6,523,715 B1 | * | 2/2003 | Dunford et al. | 221/121 |

FOREIGN PATENT DOCUMENTS

| | | |
|---|---|---|
| EP | 0296496 | 12/1988 |
| EP | 0777201 | 6/1997 |
| EP | 0910053 | 4/1999 |
| FR | 2675931 | 10/1992 |
| WO | WO 98/25240 | 6/1998 |

* cited by examiner

*Primary Examiner*—Chen Wen Jiang
(74) *Attorney, Agent, or Firm*—Carlson, Gaskey & Olds

(57) ABSTRACT

A freezer component stores and removes frozen food in response to a signal. The freezer component includes a rotatable portion, a loading side and a feeding side. Two raiseable platforms are located in each of the loading side and the feeding side. Food is loaded into the freezer component by placing food onto the platforms positioned in the loading side. The rotatable portion then rotates 180° to position the food-loaded platforms in the feeding side. The empty platforms now located in the loading side are loaded with additional food. When a signal is received, food in the feeding side is removed from the freezer component by alternately raising the two platforms holding the food. When the feeding side is empty and contains no more food, the rotatable portion rotates 180° in the reverse direction. The food loaded platforms are now located in the feeding side. The empty platforms are located in the loading side and ready for loading of additional food.

16 Claims, 2 Drawing Sheets

AUTOMATED FREEZER COMPONENT

BACKGROUND OF THE INVENTION

The present invention relates generally to a freezer component which stores frozen food and automatically removes the frozen food from the freezer component in response to a signal Freezers are used to keep objects, such as food, frozen. Freezers are commonly used in residences, grocery stores, and restaurants to keep food frozen. In the restaurant or food service industry, food is often stored in a freezer prior to preparation and serving. The food is usually manually placed into the freezer by an employee for storage. When the food is to be prepared and served, the food is manually removed by an employee and prepare for serving.

A drawback to the prior art freezers is that additional labor is needed to remove the food from the freezer prior to preparation for serving as the food is manually removed by an employee. It would be beneficial to use a freezer that automatically transfers frozen food from a freezer component to a preparation area in response to an operator request.

SUMMARY OF THE INVENTION

The freezer component of the present invention automatically removes frozen food from the freezer component in response to a signal. The freezer component includes a rotatable portion, a loading side and a feeding side. The rotatable portion is rotatable by a carousel. Two raiseable platforms are located in each of the loading side and the feeding side. Food is loaded into the freezer component by placing the food onto the platforms positioned in the loading side. The carousel then rotates the rotatable portion 180° to position the food-loaded platforms in the feeding side. Rods around the platforms prevent the food from falling from the platforms during rotation. The empty platforms now located in the loading side are loaded with additional food.

When a signal is received, food in the feeding side is automatically removed from the freezer component by alternately raising the two platforms holding the food. When a sensor detects that the feeding side is empty and contains no more food, the rotatable portion rotates 180° in the reverse direction, positioning the recently food-loaded platforms in the feeding side and the empty platforms in the loading side. Stops in the freezer component prevent over-rotation of the carousel.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
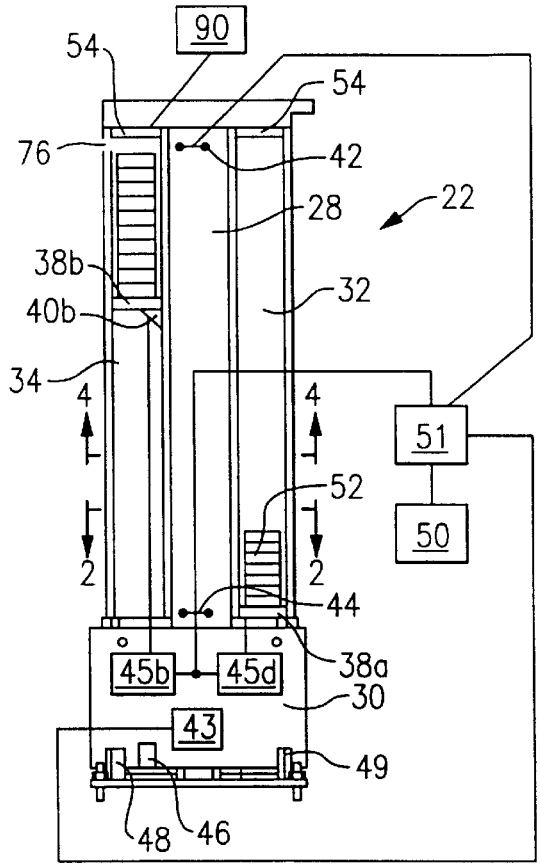
FIG. 1 schematically illustrates a side view of the freezer component of the present invention.

FIG. 1 illustrates the freezer component 22 of the present invention. Frozen food items 52, such as frozen hamburger patties, are loaded in the freezer component 22. The freezer component 22 includes a rotatable portion 28 mounted on a carousel 30. The freezer component 22 further includes a loading side 32 and a feeding side 34. An upper sensor 42 and a lower sensor 44 are located proximate to the upper end and the lower end, respectively, of the rotatable portion 28.

In one example, the freezer component 22 uses forced air convection. In another example, the freezer component comprises 22 a cold wall freezer. Preferably, the temperature in the freezer component 22 is between −18° C. and −21° C.

Figure 2:
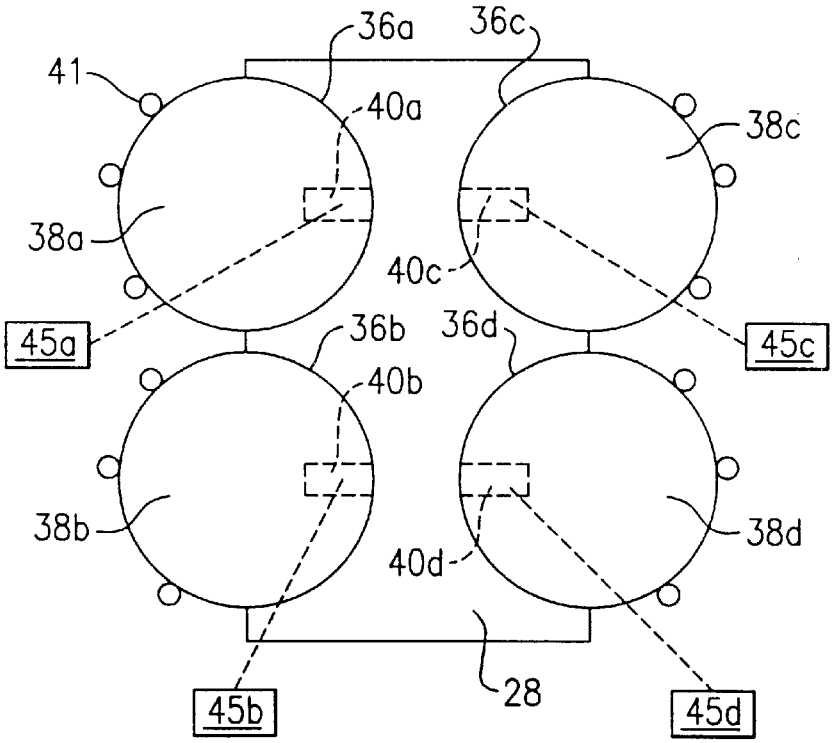
FIG. 2 schematically illustrates a cross sectional view of the freezer component of the automated grill of FIG. 1 taken along line 2—2.

As shown in FIG. 2, the example rotatable portion 28 includes four surfaces 36*a*, 36*b*, 36*c* and 36*d*. When the rotatable portion 28 is positioned as in FIG. 1, the surfaces 36*a* and 36*b* are located in the feeding side 34, and the surfaces 36*c* and 36*d* are located in the loading side 32. A platform 38*a*, 38*b*, 38*c* and 38*d* is received against each of the respective surfaces 36*a*, 36*b*, 36*c* and 36*d* and is moveable in the Y direction (i.e., up or down according to FIG. 1) by a drive 40*a*, 40*b*, 40*c*, and 40*d*, respectively, shown in phantom, which is powered by a respective motor 45*a*, 45*b*, 45*c* and 45*d* (shown in FIG. 1). Preferably, the platforms 38*a*, 38*b*, 38*c* and 38*d* are circular.

When the platforms 38*c* and 38*d* in the loading side 32 (as in FIG. 1) are in a loading position, the platforms 38*c* and 38*d* are loaded with the food items 52. Rods 41 located on the outer periphery of the platforms 38*a*, 38*b*, 38*c* and 38*d* create a cage to prevent the food items 52 from falling from the platforms 38*a*, 38*b*, 38*c* and 38*d* during rotation of the rotatable portion 28. After a desired number of food items 52 are loaded, the carousel 30 rotates the rotatable portion 28 180° in a first direction, positioning the platforms 38*c* and 38*d* with the loaded food items 52 in the feeding side 34. The same motion moves the platforms 38*a* and 38*b* to the loading side 32. The platforms 38*a* and 38*b* can then be loaded with more food items 52.

Figure 3:
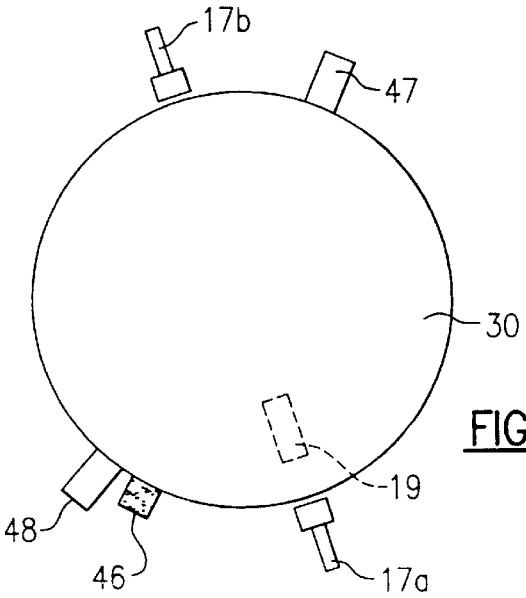
FIG. 3 schematically illustrates a top view of the carousel of the freezer component.

As shown in FIG. 3, the carousel 30 includes a magnet 19. Opposing sensors 17*a* and 17*b*, such as magnetic reed sensors, are positioned proximate to the carousel 30. When the carousel 30 rotates 180° and the sensor 17*a* detects the magnet 19, a signal is sent to the motor 43 by the control 51 to stop rotation of the carousel 30. When the carousel 30 is rotated 180° in the opposing direction and the sensor 17*b* detects the magnet 19, a signal is sent to the motor 43 by the control 51 to stop rotation of the carousel.

The carousel 30 further includes a projection 46 to prevent over-rotation. Stops 47 and 48 located in the freezer compartment 22 prevent over-rotation of the carousel 30 and tangling of wires (not illustrated). If the carousel 30 over-rotates, the projection 46 engages one of the stops 47 and 48, preventing further rotation of the carousel 30.

Returning to FIG. 1, when at least one of the food items 52 is to be grilled, an input 50 sends a signal to a control 51 which sends a signal to the desired motor 45*c* and 45*d* to raise at least one of the respective platforms 38*c* and 38*d* in the feeding side 34 for removal of the food items 52 from the freezer component 22. As the rotatable portion 28 has rotated 180°, the platforms 38*c* and 38*d* are located in the feeding side 34 and the platforms 38*a* and 38*b* are located in the loading side 32. The food items 52 are alternately delivered from the platforms 38*c* and 38*d* for removal from the freezer component 22. For example, after the input 50 sends a signal indicating a request to grill a food item 52, platform 38*c* rises to position a food item 52 for removal from the freezer component 22. When the food item 52 is raised, it is removed from the freezer component 22 by a removal device 90 and exits through the front slot 76 (shown in FIG. 5). When the next signal is received, platform 38*d* rises to position another item of food 52 for removal from the freezer component 22 by the removal device 90. A subsequent signal raises the platform 38*c*, and so on.

Preferably, the input 50 includes a POS (point of service) register. When an item of food 52 is ordered by a customer, an operator inputs the order into the POS register. The POS register sends the signal to the control 51, which responsively dispenses the desired number of food items 52. Alternatively, an operator inputs into the input 50 the numbers of food items 52 that are to be dispensed.

The platforms 38*c* and 38*d* rise until all the food items 52 in the feeding area 34 are removed. When the upper sensor 42 senses that both of the platforms 38*c* and 38*d* are positioned in an empty position, that is, the platforms 38*c* and 38*d* are in a position where all of the food items 52 are removed, the feeding side 34 is empty. The carousel 30 then rotates the rotatable portion 28 180° in an opposing direction. If the carousel 30 over-rotates, the projection 46 engages the other stop 47 (shown in FIG. 3) to prevent over-rotation. A sensor 49 monitors the position of the carousel 30 and communicates to the carousel 30 when to stop rotating.

Rotation in the opposition direction positions the platforms 38*a* and 38*b* loaded with the food items 52 in the feeding side 34, and the platforms 38*c* and 38*d* holding no food items 52 in the loading side 32. During rotation, the platforms 38*c* and 38*d* in the loading side 32 lower so they are ready to receive additional food items 52. When the lower sensor 44 senses the platforms 38*c* and 38*d* are lowered and in the loading position, the freezer component 22 knows that the loading side 32 is ready for loading of additional food items 52.

Preferably, the upper sensor 42 and the lower sensor 44 are magnetic reed switches and the platforms 38*a*, 38*b*, 38*c*, and 38*d* include a magnet. When the upper sensor 42 or lower sensor 44 sense the magnet, the sensors 42 or 44 detect the platforms 38*a*, 38*b*, 38*c* and 38*d* and can determine if the platforms 38*a*, 38*b*, 38*c* and 38*d* are in the loading portion or in the empty position.

After all the food items 52 are removed from the feeding side 34 of the freezer component 22, the platforms 38*c* and 38*d* are in the empty position. When the upper sensor 42 senses the magnet in the platforms 38*c* and 38*d* in the feeding side 34, the upper sensor 42 knows that the platforms 38*c* and 38*d* are in the empty position. The upper sensor 42 through the control 51 provides a signal to the motor 43 to rotate the carousel 30 and to the motors 45*c* and 45*d* of the respective empty platforms 38*c* and 38*d* to lower the platforms 38*c* and 38*d*. Therefore, the platforms 38*c* and 38*d* will be in the loading position once in the loading side 32. Once the platforms 38*c* and 38*d* are in the loading position in the loading side 32, the lower sensor 44 detects the magnets. Although magnetic sensors have been described, it is to be understood that other types of sensors 42 and 44 can be employed.

Figure 4:
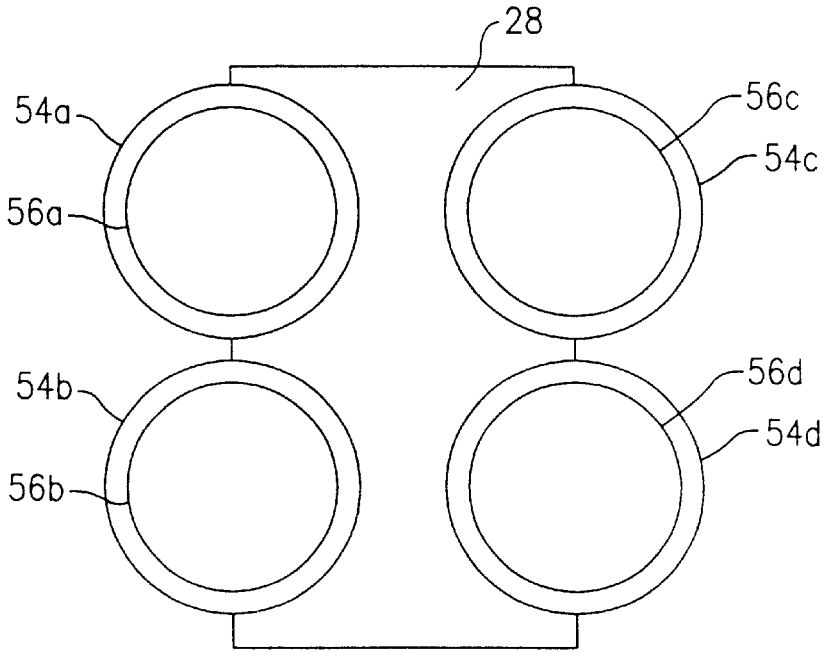
FIG. 4 schematically illustrates a cross sectional view of the freezer component of the automated grill of FIG. 1 taken along line 4—4.

As shown in FIG. 4, a ring 54*a*, 54*b*, 54*c* and 54*d* is secured to the top of the rotatable portion 28 in each of the respective four surfaces 36*a*, 36*b*, 36*c* and 36*d*. The rings 54*a*, 54*b*, 54*c* and 54*d* each include an inner aperture 56*a*, 56*b*, 56*c*, and 56*d* sized to allow passage of the food items 52. The rings 54*a*, 54*b*, 54*c* and 54*d* assist in guiding the stack of the food items 52 as the platforms 38*a*, 38*b*, 38*c* and 38*d* lift and funnel the food items 52 for removal from the freezer component 22. In one example, the rings 54*a*, 54*b*, 54*c* and 54*d* have a height which is sized to receive several food items 52 at once.

Alternatively, the freezer component 22 does not include a carousel 30 and a feeding side 34. The food items 52 are both loaded into the freezer component 22 and removed from the freezer component 22 in the loading side 32. The food items 52 can be loaded into the loading side 32 in a cartridge which contains a plurality of food items 52 to expedite the loading process.

Figure 5:
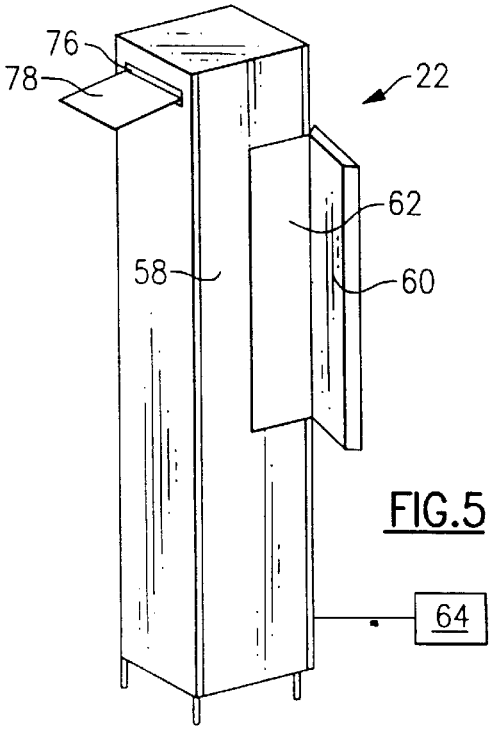
FIG. 5 schematically illustrates a perspective view of the exterior of the freezer component of the automated grill.

As shown in FIG. 5, the freezer component 22 is enclosed by a housing 58 including a door 60. When the door 60 is opened, an operator can access the loading side 32 (shown in FIG. 1) of the freezer component 22 through an access opening 62 during operation. The example freezer component 22 further includes an interlock 64 which prevents rotation of the rotatable portion 28 when the door 60 is opened.

Additionally, the frozen food items 52 can be placed in the freezer component 22 in cartridges which contain several food items 52, reducing crew labor in loading.

The freezer component 22 of the present invention can be used with an automated grill, such as described in co-pending patent application Ser. No. 10/124,629 entitled "Automated Grill" filed on Apr. 17, 2002.

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A freezer component that maintains an item in a frozen condition comprising:

a moveable portion;

a loading side for loading of the item in the freezer component;

a feeding side for removing the item from the freezer component in response to a request; and at least one item supporting platform in each of said loading side and said feeding side slidingly movable along said moveable portion.

2. The freezer component as recited in claim 1 wherein the item is selectively stacked on said at least one said platform in said loading side, and the item is removed from said freezer component by raising said at least one platform in said feeding side in response to said request.

3. The freezer component as recited in claim 2 wherein said at least one platform in said feeding side includes two platforms, and said two platforms in said feeding side alternately raise in response to said request.

4. The freezer component as recited in claim 2 wherein said moveable portion is mounted on a rotatable carousel, and rotation of said carousel 180° transfers said at least one platform between said feeding side and said loading side.

5. The freezer component as recited in claim 4 further including a lower sensor and an upper sensor, said carousel rotating 180° responsive to said upper sensor indicating that said at least one platform located in said feeding side is above a first selected position, and said lower sensor indicating when said at least one platform in said loading side is below a second selected position.

6. The freezer component as recited iii claim 5 wherein said upper sensor and said lower sensor are magnetic reed sensors.

7. The freezer component as recited in claim 4 wherein said carousel further includes a projection that engages a stop to prevent over-rotation of said carousel.

8. The freezer component as recited in claim 1 further including a controller associated with said freezer component, wherein said request comprises a signal sent by a POS device.

9. The freezer component as recited in claim 1 wherein said freezer component employs forced air convection.

10. The freezer component us recited in claim 1 wherein said freezer component employs a cold wall freezer.

11. The freezer component as recited in claim 1 wherein a temperature in said freezer component is between −18 ° C. and −21° C.

12. The freezer component as recited in claim 1 wherein said at least one platform in said feeding side includes a first two platforms and said at least one platform in said loading side includes a second two platforms.

13. The freezer component as recited in claim 1 wherein said at least one platform is substantially circular.

14. The freezer component as recited in claim 1 further including a plurality of rods positioned around an outer periphery of said at least one platform to prevent the item from falling from said platforms during rotation of said moveable portion.

15. The freezer component as recited in claim 1 further including a removal device to remove the item from said freezer component.

16. The freezer component as recited in claim 1 wherein the item is food.

* * * * *

UNITED STATES PATENT AND TRADEMARK OFFICE

CERTIFICATE OF CORRECTION

PATENT NO. : 6,751,977 B2
DATED : June 22, 2004
INVENTOR(S) : Sands et al.

It is certified that error appears in the above-identified patent and that said Letters Patent is hereby corrected as shown below:

Title page,
Item [75], Inventors, please add the following names:

-- Thomas J. Franken, Roscoe, IL (US) --
Andrew Paul Franklin, Beloit, WI (US)
Randy L. Ginner, Beloit, WI (US)
Ronald J. Glavan, Rockton, IL (US)
Scott A. Glawe, Roscoe, IL (US)
David A. Hill, Beloit, WI (US)
Michael J. Newberry, Poplar Grove, IL (US)
Jack Pellicane, Wyomissing, PA (US)
Manuel Calzada, Rolling Meadows, IL (US)
Henry Thomas Ewald, Roselle, IL (US) --

Column 5,
Line 3, "iii" should be -- in --

Signed and Sealed this

Seventeenth Day of August, 2004

JON W. DUDAS
*Acting Director of the United States Patent and Trademark Office*